US008079587B2

(12) United States Patent
Holzschneider et al.

(10) Patent No.: US 8,079,587 B2
(45) Date of Patent: Dec. 20, 2011

(54) SHEET BRAKING MECHANISM

(75) Inventors: Sascha Holzschneider, Mönchengladbach (DE); Peter Palmen, Mönchengladbach (DE); Anna Wysgol, Mönchengladbach (DE)

(73) Assignee: Heidelberger Druckmaschinen Aktiengesellschaft, Heidelberg (DE)

( * ) Notice: Subject to any disclaimer, the term of this patent is extended or adjusted under 35 U.S.C. 154(b) by 135 days.

(21) Appl. No.: 12/367,602

(22) Filed: Feb. 9, 2009

(65) Prior Publication Data

US 2009/0230618 A1 Sep. 17, 2009

(30) Foreign Application Priority Data

Feb. 25, 2008 (DE) ..... 10 2008 010 985

(51) Int. Cl.
*B65H 29/68* (2006.01)

(52) U.S. Cl. ..... 271/183; 271/182

(58) Field of Classification Search ..... 271/183, 271/182

See application file for complete search history.

(56) References Cited

U.S. PATENT DOCUMENTS

| | | | | | |
|---|---|---|---|---|---|
| 4,247,094 | A | * | 1/1981 | Vits | 271/183 |
| 4,485,708 | A | | 12/1984 | Halff et al. | |
| 4,830,355 | A | * | 5/1989 | Jeschke | 271/183 |
| 4,966,521 | A | * | 10/1990 | Frye et al. | 414/788.8 |
| 5,060,928 | A | * | 10/1991 | Vits | 271/182 |
| 5,599,012 | A | | 2/1997 | Rebeaud | |
| 5,611,529 | A | * | 3/1997 | Richarz et al. | 271/183 |
| 5,718,176 | A | * | 2/1998 | Stephan | 101/483 |
| 5,992,844 | A | * | 11/1999 | Dillinger et al. | 271/182 |
| 6,145,833 | A | * | 11/2000 | Rodewald et al. | 271/182 |
| 6,494,452 | B1 | * | 12/2002 | Karasiewicz | 271/276 |
| 6,588,582 | B2 | * | 7/2003 | Rebeaud | 198/836.2 |
| 2004/0149097 | A1 | | 8/2004 | Bayer et al. | |
| 2007/0001385 | A1 | | 1/2007 | Muller et al. | |

FOREIGN PATENT DOCUMENTS

| | | | |
|---|---|---|---|
| DE | 2720674 | A1 | 11/1978 |
| DE | 3044083 | A1 | 9/1982 |
| DE | 19835529 | A1 | 2/2000 |
| DE | 19926401 | C1 | 3/2001 |
| DE | 102005016783 | A1 | 12/2005 |
| EP | 0681975 | A1 | 11/1995 |
| EP | 1431011 | A1 | 6/2004 |

* cited by examiner

*Primary Examiner* — Stefanos Karmis
*Assistant Examiner* — Luis A Gonzalez
(74) *Attorney, Agent, or Firm* — Keating & Bennett, LLP

(57) ABSTRACT

A sheet braking mechanism for a sheet punching and/or embossing machine for the braking a sheet in a processing station of the sheet punching and/or embossing machine, includes a movable pneumatic sheet brake and a movable carrier, on which at least one brake brush is mounted. The pneumatic sheet brake and the carrier are mechanically coupled, for example, by a driving element, so that a movement of the pneumatic sheet brake causes a movement of the carrier.

9 Claims, 2 Drawing Sheets

SHEET BRAKING MECHANISM

BACKGROUND OF THE INVENTION

1. Field of the Invention

The present invention relates to a sheet braking mechanism for a sheet punching and embossing machine.

2. Description of the Related Art

Sheet processing machines, such as sheet punching machines, for example, typically include a feeder, processing stations, and a delivery unit. A sheet lying on top of a stack of sheets in the feeder is fed to a transport system. The transport system transports the sheet through the processing station to the delivery unit. A known transport system includes rotating gripper carts. The gripper carts include a transverse rod on which grippers are arranged. The grippers grab a forward edge of the sheet. The gripper carts include ends that are fastened to a side chain control which guides the gripper carts through the machine. For processing and delivery, the sheet must be braked to a standstill. This is performed by braking the gripper carts, and by additional sheet brakes. The sheet processing machines may be sheet printing machines or sheet punching and embossing machines, for example.

Punching refers to a cutting process using self-enclosed geometrical blanking shapes, which may be circular, oval, or polygonal, as well as any kind of special shape. This field also includes the practices that are performed in the further processing of printed matter, such as punching with perforation dies, rounding of edges, and register punching. The punching is performed against a punching backing or against a male die. In addition, shearing steps may also be performed. Packaging materials, such as paper, a carton, cardboard or corrugated cardboard, are primarily punched out in sheet form. However, grooved lines or blind embossings can also be made in the copies during the punching process. This complex process required the sheets to be individually punched. Since the end products are packaging items requiring highly technical and graphical design (such as packages for cosmetics, cigarettes, pharmaceuticals, foods, etc.), special requirements are placed on not only the packaging materials themselves, but also on the punching dies. For example, extremely precise and reliable punching machines having very small tolerances are required for optimal results. These requirements are best met using a flat-bed punching machine in which printed sheets that are stacked on a pallet are fed to the punching machine. The flat-bed punching machine includes an orienting mechanism in which the sheets to be punched are oriented true to size and picked up by a gripper cart and precisely positioned in the punching mechanism between a firmly mounted bottom table and a vertically movable upper table.

In known sheet punching and embossing machines which are used for punching, waste stripping, embossing and stacking of sheets of paper, cardboard, and other materials, it is known to transport the sheets through the individual stations of the machine using gripper carts. A gripper cart includes a gripper bridge on which the grippers are fastened, and the gripper cart grabs the sheets at a front end. In addition, a gripper cart includes lateral driving carts, which are connected to endless chains of the transport system and move the gripper cart through the machine. With this type of movement of the sheets through the machine, continuous operation is achieved in the individual consecutively arranged stations of the machine, such as a punching station, a waste stripping station, and a copy separation station.

Such a flat-bed punch is disclosed in DE 30 44 083 A1. Two tables are provided with cutting and grooving tools or the corresponding counter tools, by which the final copies are punched from the sheets, guided in a timed manner between the table surface, and at the same time the grooves required for clean folding are pressed into the final copies. At the following waste stripping mechanism, the waste is removed mechanically by stripping tools. Finally, depending on the configuration of the machine, the punched copies are separated in a copy separation mechanism.

In the punching station, the waste stripping station, and the copy separation station, the sheet must be braked from the transport speed to a standstill. Since the sheet that is already weakened by the preceding cutting process arrives at the stations at a high speed, merely slowing down the front gripper rod may cause its rear portion to buckle upward. This is prevented by additional braking devices which act on the surface of the sheet. A taut sheet can be processed with greater precision and transported more easily.

Two different types of sheet braking device are known in the related art. DE 695 00 514 T2, for example, shows a sheet braking device that includes brushes. The braking brushes are slanted in the direction of sheet transport and exert a braking force on the sheet by slight pressure.

In an alternative solution to this mechanical sheet brake, pneumatic sheet brakes are used, e.g., as disclosed in EP 1 431 011 B1. The pneumatic sheet brakes are arranged in close proximity to the sheet and provide a partial vacuum, which acts as a braking force on the sheet moving past the pneumatic sheet brake. Pneumatic sheet brakes have an advantage over mechanical ones in that the sheet surface is not impaired marks on the sheet surface can be avoided marks. Another known pneumatic sheet brake is disclosed in DE 10 2005 016 783 A1.

DE OS 27 20 674 discloses a rotary printing machine having a blowing device. The blowing device functions like a sheet brake and includes a strip of blowing nozzles, which can be moved in the same direction or in a direction opposite to the sheet transport direction. This is performed to adjust the sheet brake for the particular sheet delivery speed. The nozzles of the strip are supplied with compressed air and produce a partial vacuum on the underside of the sheet due to the aerodynamic paradox, so as to impart a braking force to the sheet.

DE 199 26 401 C1 discloses a method of controlling an axially adjustable sheet braking mechanism. Here, the sheet brakes can be moved in the direction of or opposite to the sheet transport direction, depending on the lengthwise format of the sheet, using guide carriages and lengthwise drive units, such as a screw.

DE 198 35 529 A1 discloses a sheet braking device for corrugated cardboard machines. The device includes suction strips which rotate in a circular orbit, and a guide roller arranged opposite to the suction strips. The suction strips are arranged below the plane of sheet transport and act on the sheet from beneath, while the guide roller is arranged above the sheet transport plane and acts on the sheet from above. The roller is used to guide the sheet.

The drawbacks of the sheet braking mechanisms of the related art include their limited braking capacity, the complicated positioning process of the braking elements after a tool change, and their complicated adjustment process to adapt to the different sheet formats. Another drawback is that there is a danger of collision between the sheet braking mechanisms and the tools when changing the print run and the tooling.

SUMMARY OF THE INVENTION

To overcome the problems described above, preferred embodiments of the present provide a sheet braking mechanism that provides a simple and secure adjustability of the sheet braking mechanism.

A sheet braking mechanism according to a preferred embodiment of the present invention for a sheet punching and/or embossing machine that is arranged to brake sheets of paper, cardboard, and other materials in a processing station, such as a punching station, an edge rounding station, or a delivery unit, includes a movable pneumatic sheet brake and a movable carrier on which at least one brake brush is mounted. The pneumatic sheet brake and the movable carrier extend across the sheet transport direction in the width direction of the sheet punching and/or embossing machine. The pneumatic sheet brake and the carrier are mechanically coupled, for example, by a driving element, so that a movement of the pneumatic sheet brake causes a movement of the carrier. This has an advantage in that when changing print jobs, the pneumatic sheet brake and brake brushes can be automatically retracted from the collision zone, and thus, the risk of a collision between the brake brushes and top-mounted tooling is substantially reduced, and at the same time, a simple adjustment of the brake brushes is enabled. The pneumatic sheet brake and the carrier with the brake brushes can advantageously move in the direction of and the direction opposite to the sheet transport direction.

According to a preferred embodiment of the present invention, the pneumatic sheet brake is preferably connected to an actuator, such as a spindle motor or a controllable electric motor, and the adjustment of the pneumatic sheet brake is performed by this actuator. Preferably, the actuator is connected to and actuated by a control unit. The control unit ensures that the pneumatic sheet brake is automatically positioned based on the format of the sheet and the format of the processing tools of the processing station. If the sheet format corresponds to the format of the processing tools, the pneumatic sheet brake will preferably be positioned at a location relative to the rear edge of a sheet in its resting position in the processing station. If the sheet format is smaller in size than the format of the processing tools, the pneumatic sheet brake will be positioned at the rear edge of the processing tool, when viewed in the sheet transport direction, so that no collisions can occur between tool and sheet braking mechanism during the lifting movements of the processing tool.

Preferably, the carrier is moveable relative to the pneumatic sheet brake in a direction of and a direction opposite the sheet transport direction. This movement is preferably performed manually and makes it possible to adjust the sheet brake carrier so that collisions between sheet brake carrier and upper tooling are always avoided.

Preferably, the sheet brake mechanism includes a clamping mechanism arranged to arrest the carrier with the brake brushes relative to the machine frame of the sheet punching and/or embossing machine. Here, the arresting can preferably be performed pneumatically, hydraulically, electromechanically, or mechanically/manually, for example.

The pneumatic sheet brake is preferably a nozzle strip which functions by Bernoulli's principle. Preferably, the at least one brake brush is arranged to swivel on the carrier and can be timed so as to swivel about an axis parallel or substantially parallel to the lengthwise dimension of the carrier, such that the at least one brake brush temporarily acts on one sheet.

Another preferred embodiment of the present invention provides a sheet punching and/or embossing machine which includes the above-described sheet brake mechanism. Advantageously, all operator elements required to operate the sheet brake mechanism and to move the pneumatic sheet brake and/or the carrier are arranged at the operator side of the sheet punching and/or embossing machine. This enables simple and ergonomic adjustment with reduced outfitting times.

Another preferred embodiment of the present invention provides a method for changing and adjusting the position of a pneumatic sheet brake and at least one brake brush of a sheet brake mechanism. Prior to a job change, the sheet brake mechanism is automatically moved from the collision zone with the tooling into its most upstream position as viewed in the sheet transport direction. The brake brush carrier may be manually pushed even further upstream. This enables the processing tools to be easily brought into the processing station with no problem. Beginning from this position, the pneumatic sheet brake is automatically moved by an actuator in the sheet transport direction, so that the pneumatic sheet brake is adjusted at the rear edge of the sheet or the rear edge of a processing tool. Since the pneumatic sheet brake and the carrier with the brake brushes are mechanically coupled, the carrier is also moved. In a next step, the carrier can be manually moved even further. If the brake brush carrier has been lifted prior to its movement due to the job change, then the brake brush carrier will now be lowered into its working position. In a subsequent step, the clamping mechanism is activated, thereby fixing the carrier relative to the machine frame.

Moreover, the sheet punching and/or embossing machine preferably includes separate drive units for the sheet transport system and the individual processing stations. Preferably, the drive unit of the sheet transport system can be designed as a linear drive with alternating field motors, for example.

Other features, elements, processes, steps, characteristics and advantages of the present invention will become more apparent from the following detailed description of preferred embodiments of the present invention with reference to the attached drawings.

DETAILED DESCRIPTION OF PREFERRED EMBODIMENTS

Figure 1:
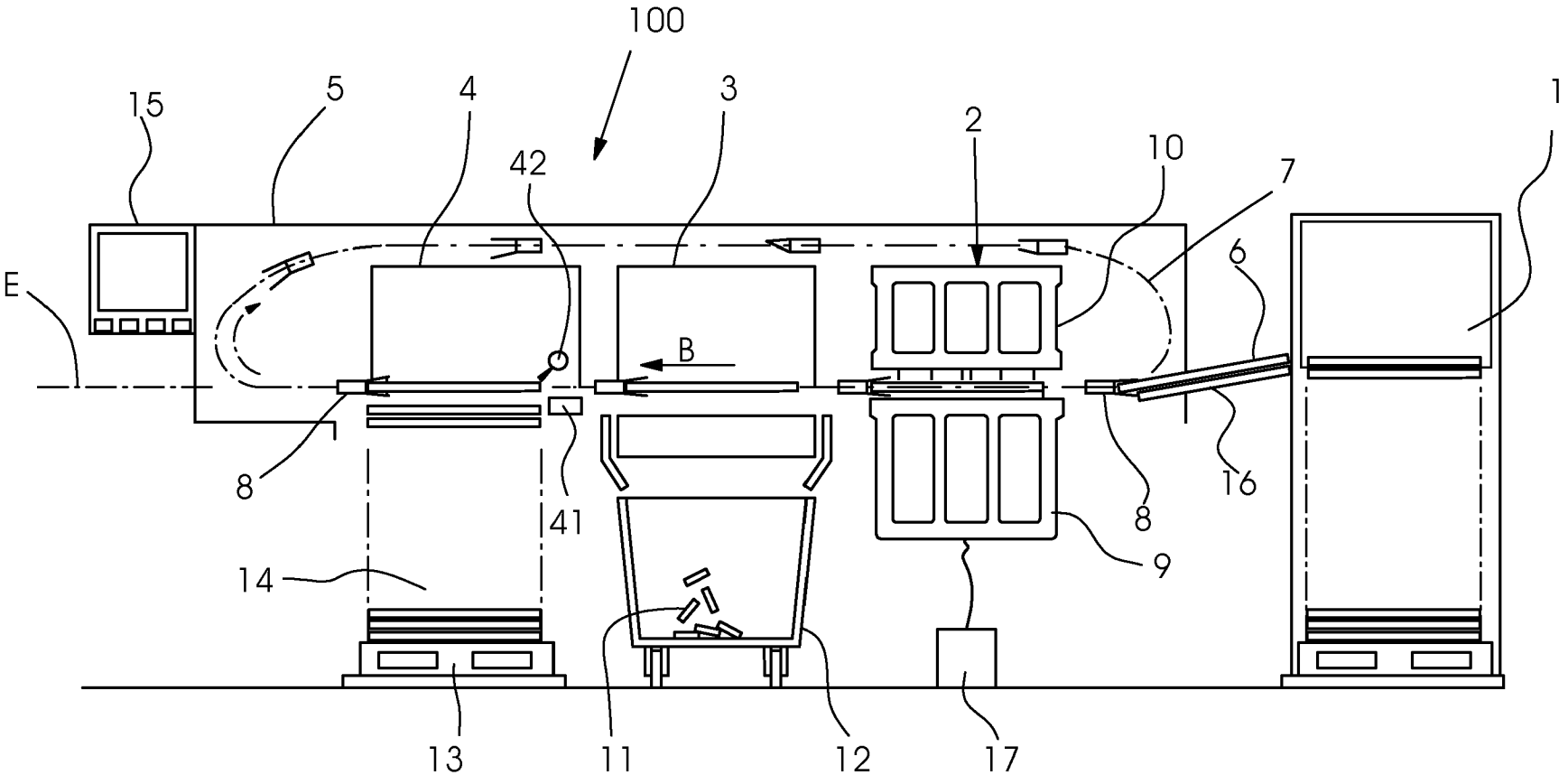
FIG. 1 shows a sheet punching and/or embossing machine with a sheet brake mechanism according to a preferred embodiment of the present invention.

FIG. 1 shows the basic layout of a sheet punching and/or embossing machine 100 for the punching, waste stripping, and stacking sheets of paper, cardboard, and other suitable materials. The sheet punching and/or embossing machine 100 includes a feeder 1, a punching station 2, a waste stripping station 3, and a delivery unit 4 which are disposed in and enclosed by a common machine housing 5.

The sheets 6 are picked from a stack by a feeder 1, fed to the sheet transport system 7 and grabbed by their front edge by grippers secured to gripping bridges of a gripper cart 8 and transported in the sheet transport direction B intermittently through the stations 2, 3 and 4 of the sheet punching and/or embossing machine 100.

The sheet transport system 7 includes several gripper carts 8, so that several sheets 6 can be processed at the same time in the stations 2, 3 and 4.

The punching station 2 includes a lower platen called a lower table 9, and an upper platen called an upper table 10. The upper table 10 can move vertically back and forth and is provided with punching and grooving blades. The lower table 9 is fixedly mounted in the machine frame and includes a counterplate for the punching and grooving blades.

The gripper cart 8 transports the sheet 6 from the punching and embossing station 2 to the waste stripping station 3, which includes waste stripping tools. At the waste stripping station 3, the scrap pieces are pushed off and downward from the sheet 6 by the waste stripping tools, so that the waste pieces 11 fall into a cart 12 disposed underneath the station.

From the waste stripping station 3, the sheet 6 is transported to the delivery unit 4, where the sheet 6 is either set aside or a separation of the finished copies is performed. The delivery unit 4 includes a pneumatic sheet brake 42 which acts on an individual sheet 6 from below, and a brake brush 42 which acts on an individual sheet 6 from above. Both braking mechanisms 42, 43 are positioned at the rear edge of the sheet 6. The delivery unit 4 can also includes a pallet 13 on which the individual sheets 6 are disposed in the form of a stack 14, so that after the stacked-up sheets 6 reach a given height on the pallets 14, the stacked-up sheets 6 can be move away from the punching and embossing machine 100.

Figure 2:
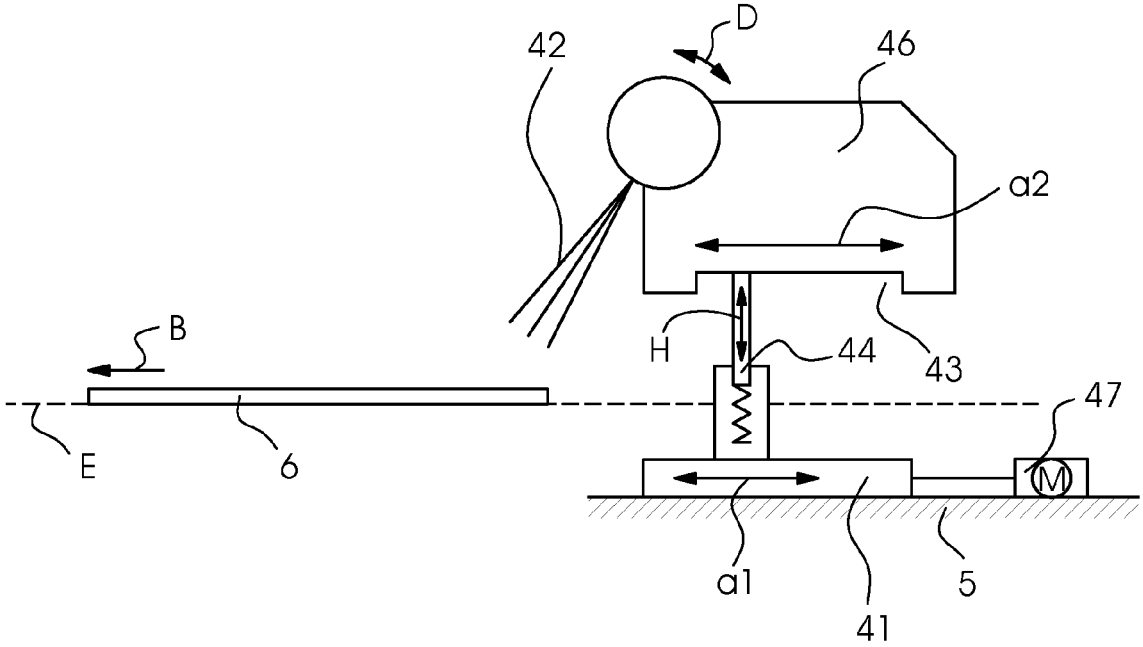
FIG. 2 shows a front view of the sheet brake mechanism according to a preferred embodiment of the present invention.

FIG. 2 shows a front view of a sheet braking mechanism according to a preferred embodiment of the present invention. The device includes two different brake elements: a pneumatic sheet brake 41 which is preferably defined by a nozzle strip, and a plurality of brake brushes 42. The pneumatic sheet brake 41 is arranged below the sheet transport plane E and acts from below on a sheet 6 transported in the sheet transport direction B by applying suction thereto. The brake brushes 42 are arranged above the sheet transport plane B and act from above on a sheet 6 transported in the sheet transport direction B by applying a slight pressure. The brake brushes 42 are arranged on a carrier 46 that extends across the sheet transport direction B such that the brake brushes 42 can be swiveled in timed manner by a swiveling motion D. Due to the swiveling motion D, the brake brushes 42 are lowered onto a sheet 6 when the sheet 6 is located beneath the brake brushes 42 and then lifted upwards again.

The pneumatic sheet brake 41 and the brake brush carrier 46 are mechanically coupled by a driving bolt 44. The driving bolt 44 is pressed by a spring against a groove 43 provided in the carrier 46. Thus, the driving bolt 44 is vertically movable is the direction H in the pneumatic sheet brake 41. The groove 43 may preferably be bounded in the carrier 46, as shown in FIG. 2. In this manner, the carrier 46 is moved by the driving bolt 44 in the direction of and opposite to the transport direction B. If the groove 43 is only bounded at one of its ends, the carrier 46 can be moved by the driving bolt 44 in only one direction, and the position of the carrier can be manually reset.

The pneumatic sheet brake 41 can be moved, i.e., displaced in the direction of and opposite to the sheet transport direction B, as indicated by the double arrow a1. In this preferred embodiment, the pneumatic sheet brake 41 is driven by an actuator, and preferably by an electric motor. This makes it possible to position the pneumatic sheet brake 41 based on the sheet format at an optimal position relative to the rear edge of a sheet in its resting position during the processing in the processing station. At the time of a tool change, the brake elements 41, 42 can be automatically moved away from the collision zone. Due to the mechanical coupling of pneumatic sheet brake 41 and carrier 46, the carrier 46 is also moved when the pneumatic sheet brake 41 is moved. Once the pneumatic sheet brake 41 is in the correct position, the carrier 46 can be additionally displaced within the dimensions of the groove 43 in the direction of or opposite to the sheet transport direction B. This additional displacement a2 is preferably performed manually and enables a more exact positioning of the brake brushes 42 based on the sheet format of the sheets 6 and enables the brake brush carrier 46 to be moved further away from the collision zone with the upper tools. Once the brake brushes 42 are correctly positioned, the carrier 46 can be lowered in direction H into its working position and, as shown in FIG. 3, fixed relative to the machine frame 5.

Figure 3:
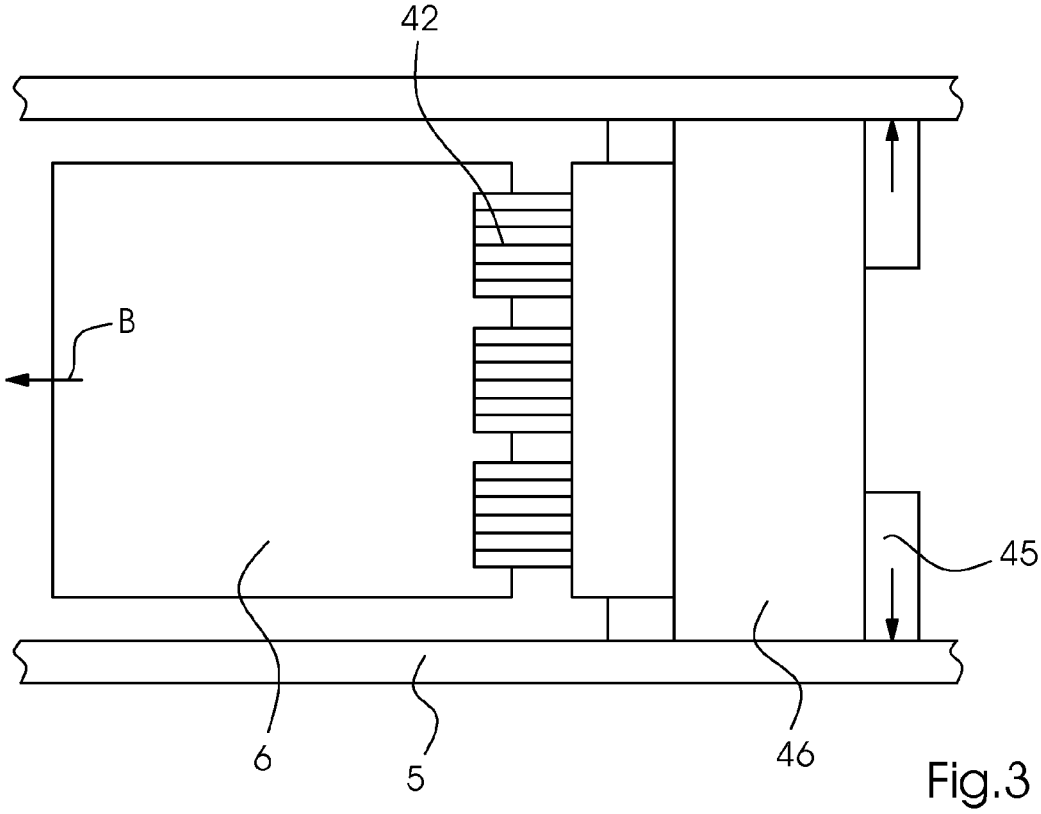
FIG. 3 shows a top view of the sheet brake mechanism according to a preferred embodiment of the present invention.

FIG. 3 shows a top view of the sheet braking mechanism according to a preferred embodiment of the present invention. The brake brush carrier 46 is connected to a clamping mechanism 45 by which the carrier 46 is fixed by strips that are connected to the machine housing 5. The pneumatic sheet brake 41 is not shown in FIG. 3, as it is concealed by the carrier 46.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. A sheet braking mechanism for a sheet punching and/or embossing machine for braking a sheet in a processing station of the sheet punching and/or embossing machine, the sheet braking mechanism comprising:

a movable pneumatic sheet brake;

a movable carrier; and at least one brake brush mounted on the carrier; wherein the pneumatic sheet brake and the carrier are mechanically coupled to one another;

a movement of the pneumatic sheet brake causes a movement of the carrier;

the pneumatic sheet brake and the carrier are arranged to move linearly and in parallel to a sheet transport direction and a direction opposite to the sheet transport direction; and the carrier is arranged to move relative to the pneumatic sheet brake in the sheet transport direction and the direction opposite to the sheet transport direction.

2. The sheet brake mechanism according to claim 1, further comprising:

an actuator; wherein the pneumatic sheet brake is connected to the actuator; and adjustment of the pneumatic sheet brake is performed by the actuator.

3. The sheet brake mechanism according to claim 2, wherein the actuator is an electric motor.

4. The sheet brake mechanism according to claim 2, further comprising:

a control unit; wherein the actuator is connected to the control unit;

the control unit is arranged to actuate the actuator; and the pneumatic sheet brake is arranged to be automatically positioned by the actuator based on a format of the sheet and a format of processing tools of the processing station.

5. A sheet brake mechanism according to claim 1, wherein the pneumatic sheet brake is a nozzle strip which utilizes Bernoulli's principle.

6. A sheet brake mechanism according to claim 1, wherein the pneumatic sheet brake and the carrier are mechanically coupled by a driving element.

7. A sheet punching and/or embossing machine including a sheet brake mechanism according to claim 1.

8. A sheet braking mechanism for a sheet punching and/or embossing machine for braking a sheet in a processing station of the sheet punching and/or embossing machine, the sheet braking mechanism comprising:

a movable pneumatic sheet brake;

a movable carrier; and at least one brake brush mounted on the carrier; wherein the pneumatic sheet brake and the carrier are mechanically coupled to one another;

a movement of the pneumatic sheet brake causes a movement of the carrier; and the sheet brake mechanism includes a clamping mechanism arranged to clamp the carrier in a fixed position.

9. A sheet braking mechanism for a sheet punching and/or embossing machine for braking a sheet in a processing station of the sheet punching and/or embossing machine, the sheet braking mechanism comprising:

a movable pneumatic sheet brake;

a movable carrier; and at least one brake brush mounted on the carrier; wherein the pneumatic sheet brake and the carrier are mechanically coupled to one another;

a movement of the pneumatic sheet brake causes a movement of the carrier;

the at least one brake brush is arranged to swivel on the carrier in timed manner about an axis perpendicular or substantially perpendicular to the sheet transport direction; and the carrier is arranged to move relative to the pneumatic sheet brake in the sheet transport direction and the direction opposite to the sheet transport direction.

* * * * *